United States Patent [19]

Akiyama

[11] Patent Number: 4,956,677

[45] Date of Patent: Sep. 11, 1990

[54] CLEANING DEVICE FOR IMAGE FORMING APPARATUS

[75] Inventor: Keiichi Akiyama, Iwate, Japan

[73] Assignee: Alps Electric Co., Ltd., Tokyo, Japan

[21] Appl. No.: 308,858

[22] Filed: Feb. 9, 1989

[30] Foreign Application Priority Data

Feb. 29, 1988 [JP] Japan ..... 63-46100

[51] Int. Cl.[5] ..... G03G 15/00; G03G 15/08; G03G 21/00

[52] U.S. Cl. ..... 355/303; 355/301; 118/652; 430/125

[58] Field of Search ..... 355/303, 301, 302; 15/1.5, 256.51; 118/652, 657; 430/125

[56] References Cited

U.S. PATENT DOCUMENTS

| | | | |
|---|---|---|---|
| 3,580,673 | 5/1971 | Yang | 355/306 |
| 3,914,045 | 10/1975 | Namiki et al. | 355/270 |
| 4,185,910 | 1/1980 | Nomura et al. | 355/303 X |
| 4,506,975 | 3/1985 | Shukuri et al. | 355/299 |
| 4,660,962 | 4/1987 | Maekawa et al. | 355/303 |
| 4,755,853 | 7/1988 | Shimizu et al. | 355/303 X |
| 4,819,026 | 4/1989 | Lange et al. | 355/303 X |

FOREIGN PATENT DOCUMENTS

| | | |
|---|---|---|
| 0001413A1 | 9/1978 | European Pat. Off. . |
| 1527441 | 11/1976 | United Kingdom . |

OTHER PUBLICATIONS

IBM Technical Disclosure Bulletin, vol. 30, No. 3, Aug. 1987 (New York), "Three-Stage Preclean Treatment", pp. 1250–1252, See FIGS. 1 and 2.

*Primary Examiner*—A. C. Prescott

*Attorney, Agent, or Firm*—Guy W. Shoup; Paul J. Winters

[57] ABSTRACT

Disclosed is a cleaning system for an image forming apparatus wherein the cleaning performance thereof will not be deteriorated by, will be substantially free from a change of the environment therearound and damage to a photosensitive member of the image forming apparatus is minimized in order to improve the life of the photosensitive member. The cleaning system comprises a conductive cleaning brush for slidably contacting with the photosensitive member to remove toner powder remaining on the photosensitive member. Toner powder remaining on the photosensitive member after transfer of a visible toner powder image therefrom is first charged to a fixed polarity, using a DC corona discharge or the like and then the photosensitive member is slidably contacted by the conductive cleaning brush to which a bias voltage of the polarity opposite to the polarity of the charge on the toner powder is applied so that the remaining toner powder is mechanically and electrostatically removed from the photosensitive member by the conductive cleaning brush.

6 Claims, 4 Drawing Sheets

FIG. 8a AFTER DEVELOPMENT

FIG. 8b AFTER TRANSFER

FIG. 8c AFTER PRE-CHARGE

CLEANING DEVICE FOR IMAGE FORMING APPARATUS

BACKGROUND OF THE INVENTION

1. Field of the Invention

This invention relates generally to a device for cleaning an image carrier for an image forming apparatus such as a printer or a copying machine in which electrophotographic technology is adopted, and more particularly to a cleaning device of the type mentioned which employs a conductive cleaning brush therein.

2. Description of the Prior Art

In recent years, page printers represented by laser printers have been become major recording apparatus from the viewpoint of their quietness, high recording speed, and high quality printed results. Most of such page printers form a picture image using electrophotographic technology and generally have a construction as shown in FIG. 2. Referring to FIG. 2, a recording device shown includes a photosensitive member 1 serving as an image carrier located substantially at the center within a housing, with a charger 2, an optical writing device 3, a developing device 4, a transfer device 5, a fixing device 6, a charge removing device 7 and a cleaning device 8 are arranged in this order around the photosensitive member 1. A supply paper cassette 9 and a discharged paper tray 10 are removably mounted on the housing of the recording device.

In a process of forming a picture image with such a recording device as described just above. The photosensitive member 1 which is rotating in the direction indicated by an arrow mark A in FIG. 2 is charged with electricity by the charger 2. An electrostatic latent image corresponding to information of a picture image to be recorded is formed on the photosensitive member 1 by the optical writing device 3. Colored fine particles of an average particle size of 10 to 20 microns (hereinafter referred to as "toner powder") are applied by the developing device 4 so as to selectively adhere to the photosensitive member 1 in accordance with a pattern of the electrostatic latent image in order to convert the image into a visible image. A record sheet 11 of paper is supplied from the supply paper cassette 9 and transported along a substantially horizontal paper transport path extending from the supply paper cassette 9 to the discharged paper tray 10. The visible image of toner powder on the photosensitive member 1 is thus transferred by electrostatic attractive force of the transfer device 5 to a lower face of the record sheet 11 being transported between the transfer device 5 and the photosensitive member 1. The visible image of toner powder on the record sheet 11 is fixed by heat or pressure. The photosensitive member 1 having passed the transfer area rotates past the charge removing device 7 by which the remaining charge on a surface thereof is removed using light or discharge. Toner powder still remaining on the photosensitive member 1 is removed by the cleaning device 8, thereby completing the picture image forming process for one page.

Prior art cleaning systems, as illustrated in FIGS. 3, 4 and 5, have been conventionally put into practical use as methods of removing remaining toner powder. FIG. 3 illustrates a system called a blade cleaning system wherein a blade 15, made of an elastic material such as polyurethane rubber, is pressed at a predetermined angle against a surface of a photosensitive member 1 to mechanically scrape toner powder off the photosensitive member 1.

FIG. 4 shows another system called blower cleaning system wherein a brush roll 13' and an absorbing fan 17 for collecting toner powder are employed. The brush roll 13' is formed by implanting a large number of insulating yarn strings made of a high-molecular polymer such as, for example, nylon or acrylic resin into a ground fabric. The opposite side of the ground fabric is coated with a bonding agent by means of such a back coating device 18 as shown in FIG. 7. Then the ground fabric is wrapped around a roll member. The brush roll 13' is disposed at a position at which the brush fibers contact with a photosensitive member 1 which is rotating in the direction indicated by an arrow mark A in FIG. 4. As the brush roll 13' is rotated in the direction, for example, indicated by an arrow mark B in FIG. 4, the brush thereof is slidably contacted with the photosensitive member 1 whereupon it is contacted with toner powder T remaining on the photosensitive member 1. During the mechanical scraping of the toner powder T off the photosensitive member 1, an electric charge is imported to the surface of the brush fibers of the brush roll 13' due to frictional contact with the photosensitive member 1 during high speed rotation of the brush roll 13' to electrostatically remove the toner powder T from the photosensitive member 1. The toner powder transferred to the brush 13' is then transported in the direction indicated by an arrow mark D in FIG. 4 by the absorbing fan 17 and collected into a collection toner box not shown, thereby enabling continuous cleaning of the photosensitive member.

FIG. 5 shows an improvement to the blower cleaning system described above which is called insulating brush cleaning system. This system makes use of an insulating brush 13' to remove toner powder from a photosensitive member in a similar manner as in the blower cleaning system, but differs from the blower cleaning system illustrated in FIG. 4, in the method of collecting the toner powder attached to the brush 13'. In particular, according to the method, toner powder attached to the brush 13' is collected, for example, by means of a metal roll 14 which is contacted with the brush 13' to cause toner powder attached to the brush 13' to be transferred to the metal roll 14. More particularly, the method of transferring toner powder to the metal roll might incorporate a bias voltage of a polarity opposite to the polarity of charge of toner powder applied to the metal roll to cause toner powder to be collected by an electrostatic attracting force. Alternatively, a magnetized toner powder and a magnetic roll of opposite polarities might be used to cause toner powder to be magnetically attached and collected. These methods are improved so as to prevent an increase in size of an apparatus which is a defect of the blower cleaning system.

Finally, toner powder attached to the metal roll described above is mechanically scraped off the metal roll 14 and collected by means of a scraper 16 which is disposed in normal contact with the metal roll 14. In this way, member can be continuously cleaned by the metal roll.

However the conventional cleaning systems described above, have significant problems as described below. First, according to the blade cleaning system, a blade must be pressed against a photosensitive member under a high pressure in order to attain a high cleaning performance. The blade cleaning system has such a structure that the blade is pressed at an acute angle against the photosensitive member to clean the photosensitive member only with a mechanical scraping off force. If the cleaning operation is repeated in such a manner as described just above, not only is toner powder removed from the photosensitive member but the surface of the photosensitive member itself is gradually abraded also as it is slidably contacted by the blade. Accordingly, damage to the photosensitive member is so significant that a long life of the photosensitive member cannot be assured. Second systems which employ an insulating brush as in a blower cleaning system or an insulating brush cleaning system, do not damage the photosensitive member as significantly as that of the blade cleaning system. The insulating brush is rotated at a high speed to provide an electric charge to the brush through frictional contact thereof with the photosensitive member, toner powder, to electrostatically remove the toner powder. Nevertheless, some damage to the photosensitive member cannot be avoided. Improvement in life of the photosensitive member cannot be anticipated. Third both systems require a mechanism is required for rotating the brush at a high speed which increases, the number of parts needed and, the production cost. In addition, cumbersome problems of production of noises and countermeasures for the same are also involved. Finally that toner powder attached to the brush is dispersed by a centrifugal force which contaminates the inside of the image forming apparatus.

FIG. 6 shows a cleaning system which employs a conductive brush and resolves the problems described above. The cleaning system is constructed such that a positive DC bias voltage is applied to a cleaning brush formed from conductive fiber to remove toner powder of a negative charge property remaining on a photosensitive member after transfer of a visible toner powder image. Since remaining toner powder is removed by applying a bias voltage to the conductive brush, it is possible to lower the rotational speed of the brush. Thus cleaning system of FIG. 6 can resolve the various problems described above with said insulating brush cleaning systems, Including the improvement in life of the photosensitive member.

However, the cleaning system, wherein a bias voltage is applied to a conductive cleaning brush, in described in FIG. 6 above still presents the following problems when it is put into practical use. After development of the image, the negatively charged toner powder is transported to a transfer area while maintaining its negative charge, and in the transfer area, it is electrostatically adhered to record paper which has been charged to a positive potential by positive corona discharge. Toner powder which has not been transferred to record paper 11 inevitably remains on the photosensitive member 1, and part of this toner powder is reversely charged to the positive polarity by an influence of the positive corona used in transfer. The distributions are of particle charge illustratively shown in FIG. 8*a* and FIG. 8*b* in which the polarities of charge of toner powder and the distributions of quantities are illustrated by way of graphs. Referring to FIG. 8*a* and FIG. 8*b*, the polarity of part of toner powder having the negative polarity after development 1 is FIG. 8*a* reversed to the positive polarity after transfer see FIG. 8*b*, and as a result, toner powder which is charged to the positive polarity and toner powder which remains charged to the negative polarity will be present in a mixture on the photosensitive member. Accordingly, even if the photosensitive member is cleaned by a conductive cleaning brush to which a positive voltage is applied, the toner powder charged to the positive polarity will not be removed from the photosensitive member 1 and therefore, complete cleaning of the photosensitive member will not be attained.

In order to attain effective cleaning, it is necessary to set conditions such that toner powder may not be charged to the positive polarity upon transfer. However setting the conditions, is very difficult because the transfer makes use of a very unstable phenomenon of discharge. Moreover, positive charging of the toner powder occurs automatically as toner powder occurs as transfer corona leaks through the record paper. Furthermore transfer corona leakage appears more intensely as the record paper absorbs moisture to decrease the electric resistance thereof. Consequently the number of particles of toner powder which are charged to the positive polarity increases progressively as the humidity increases environment. As a result, as the environmental conditions vary, the toner charge polarity will vary, and the optimum bias voltage to be applied to the conductive cleaning brush will require adjustment to attain effective cleaning. A mechanism would be required which continuously measures environmental conditions and applies a feed-back to the set conditions. This requirement would complicate the system and increase the production cost.

SUMMARY OF THE INVENTION

It is an object of the present invention to provide a cleaning device for an image forming apparatus wherein the cleaning performance thereof will not be deteriorated by and will be substantially free from a change of the environment therearound.

It is another object of the present invention to provide a cleaning device for an image forming apparatus wherein damage to an image carrier is minimized to improve the life of the image carrier.

In order to attain the objects, one aspect of the present invention provides a cleaning system for an image forming apparatus of the type wherein an electrostatic latent image on an image carrier is developed with colored fine particles, and the colored fine particles of the developed image are transferred to a transfer medium, the cleaning system being provided to remove colored fine particles remaining on the image carrier after transfer of the developed image. The cleaning system comprising a conductive cleaning brush for slidably contacting with the image carrier to remove colored fine particles remaining on the image carrier, a voltage applying means for applying a bias voltage of the polarity opposite to the polarity of charge of colored fine particles to the conductive cleaning brush, and a precharging means for charging colored fine particles remaining on the image carrier to a predetermined fixed polarity, using DC corona discharge and/or the like.

According to another aspect of the present invention, there is provided a cleaning system for an image forming apparatus of the type wherein an electrostatic latent image is formed on an image carrier and developed with colored fine particles, and the colored fine particles of the developed image are transferred to a transfer medium to form a picture image on the transfer medium. The cleaning device comprising a precharging means, using DC corona discharge or the like, for charging colored fine particles remaining on the image carrier after transfer of the developed image to a predetermined fixed polarity, and a conductive cleaning brush for removing the colored fine particles remaining on the image carrier, whereby a bias voltage of the polarity opposite to the polarity of charge of colored fine particles is applied to the conductive cleaning brush.

According to a further aspect of the present invention, there is provided an image forming apparatus which comprises a housing, a paper supply means for supplying paper therefrom, a discharged paper tray for receiving printed paper thereon, a paper transport path provided at an upper location within the housing and extending from the paper supply means to the discharged paper tray, an image carrier disposed below the paper transport path and having a surface on which an electrostatic latent image can be formed, a developing means for developing an electrostatic latent image formed on the image carrier with colored fine particles, a transfer device disposed in an opposing relationship to the image carrier across the paper transport path for transferring a visible image developed by the developing means to a lower face of paper supplied from the paper supply means, a precharging means, for example using a DC corona discharge or the like for charging colored fined particles remaining on the image carrier after transfer of the developed visible image to a predetermined fixed polarity, a conductive cleaning brush for removing the remaining colored fine particles charged to the predetermined fixed polarity by the precharging means, and a power source for applying a bias voltage to the conductive cleaning brush.

With the cleaning system for an image forming apparatus according to the present invention, colored fine particles remaining on the image carrier after transfer are charged to the predetermined fixed polarity by the precharger prior to cleaning the image carrier, and then as a brush roll is rotated, the remaining colored fine particles are contacted by the conductive cleaning brush and thus acted upon by a mechanical scraping off force from the conductive cleaning brush while a bias voltage of the polarity opposite to the polarity of the precharge is applied to the conductive cleaning brush so that the remaining colored fine particles are electrostatically attracted to the surface of the brush and thus removed from the image carrier.

Further, colored fine particles attached to the brush are attracted to the surface of a metal roll to which a voltage having the same polarity as and a greater absolute value than the voltage applied to the brush is applied, whereby the colored fine particles are mechanically scraped off the metal roll by a scraper contacted with the metal roll.

The above and other objects, features and advantages of the present invention will become apparent from the following description and the appended claims, taken in conjunction with the accompanying drawings.

BRIEF DESCRIPTION OF THE DRAWINGS

FIG. 8*a* shows a graph of the charge polarity distributions of toner powder on a photosensitive member at the developing step.

FIG. 8*b* shows a graph of the charge polarity distributions of toner powder on a photosensitive member at the transferring step.

FIG. 8*c* shows a graph of the charge polarity distributions of toner powder on a photosensitive member at the pre-charging step.

DESCRIPTION OF THE PREFERRED EMBODIMENT

Figure 1:
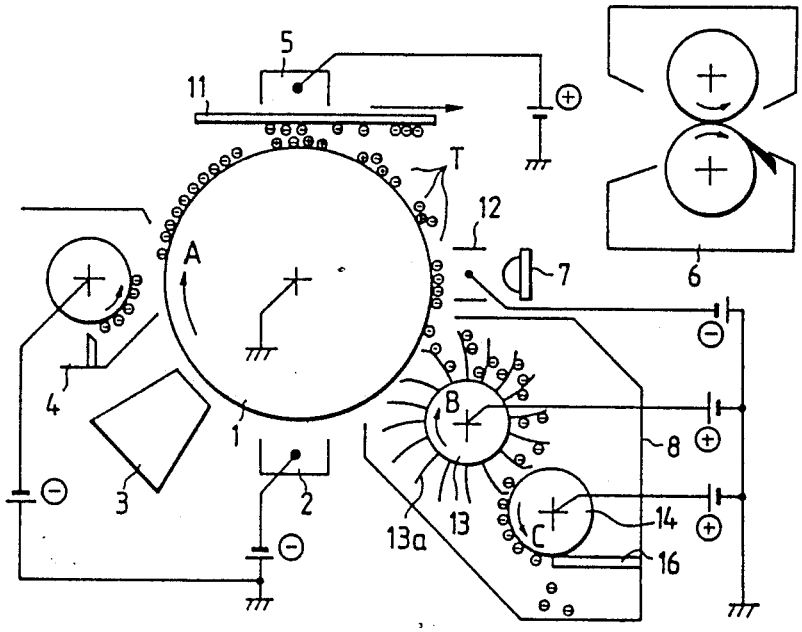
FIG. 1 is a schematic view of an image forming apparatus in which a cleaning system according to the present invention is incorporated.
Figure 2:
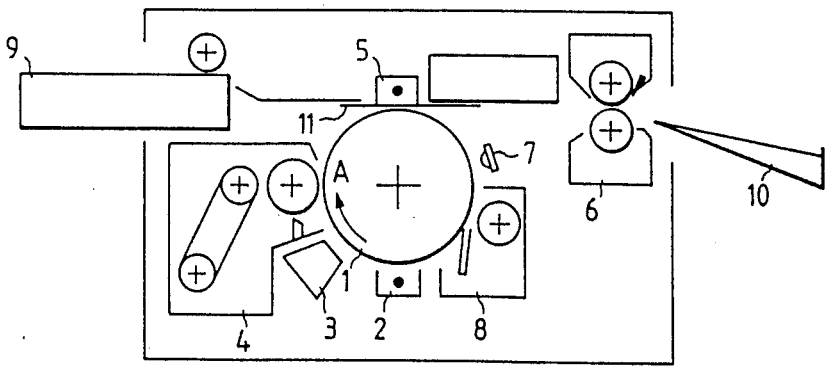
FIG. 2 PRIOR ART
FIG. 2 is a schematic view showing an entire image forming apparatus of the conventional electrophotographic type.
Figure 3:
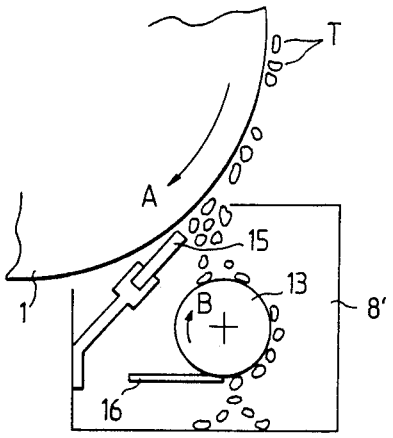
FIG. 3 PRIOR ART
FIGS. 3 to 6 are schematic views illustrating conventional cleaning systems.
Figure 4:
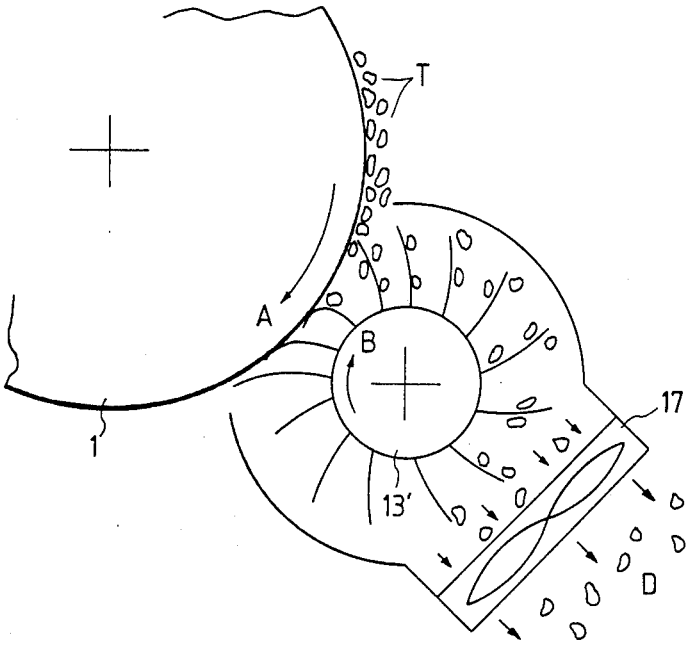
FIG. 4 PRIOR ART
Figure 5:
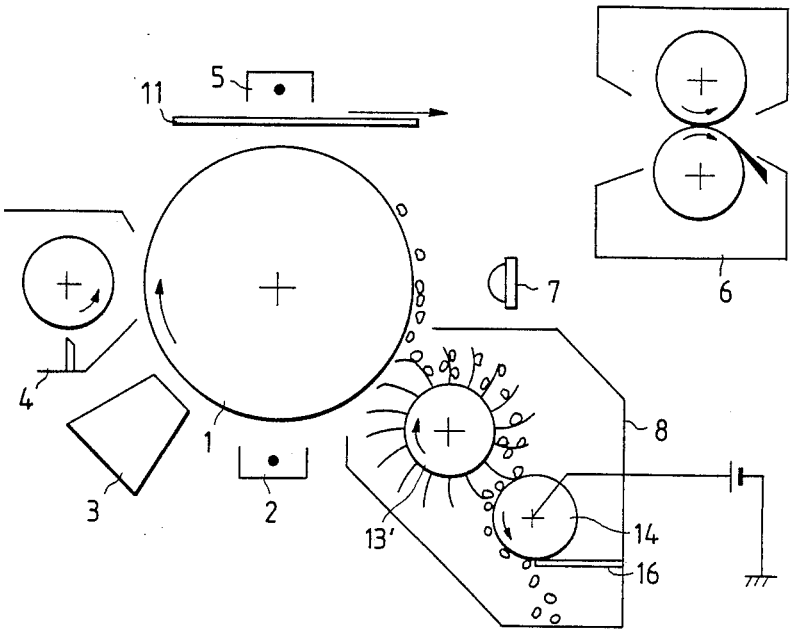
FIG. 5 PRIOR ART
Figure 6:
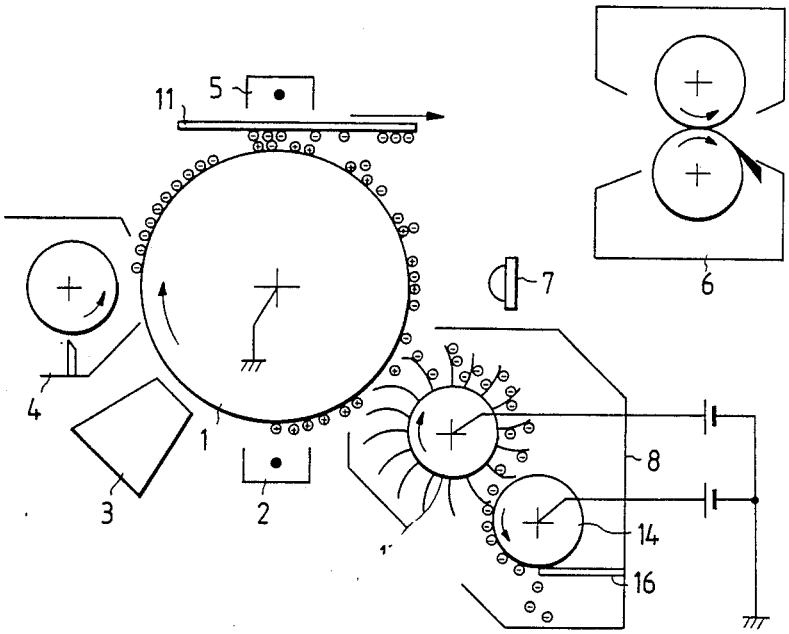
FIG. 6 PRIOR ART
Figure 7:
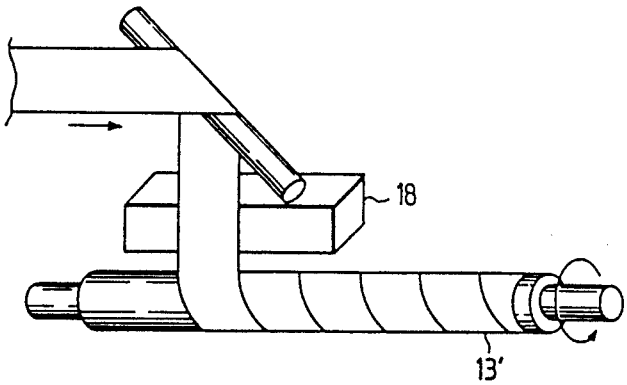
FIG. 7 is a schematic view illustrating a manner of producing a conventional cleaning brush.
Figure 7:
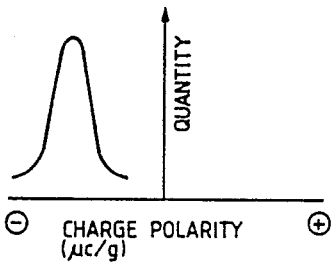
Figure 7:
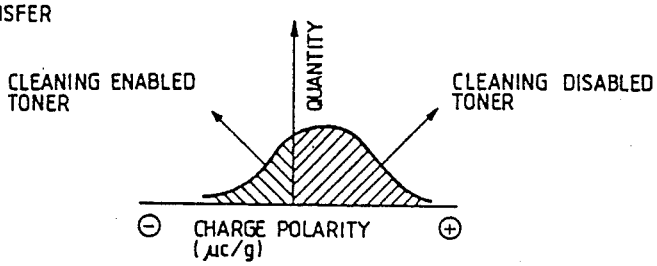
Figure 7:
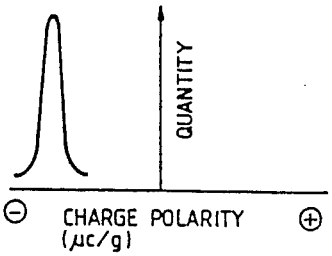

Referring to FIG. 1, there is shown an image forming apparatus in which a cleaning system according to the present invention is incorporated. The image forming apparatus includes a photosensitive member 1 consisting of a base pipe of aluminum on which a photosensitive material is applied uniformly in a single layer or in a plurality of layers. When light is irradiated upon a surface of the photosensitive member 1 after having been charged by such means as a corona discharge, pairs of electron holes and electrons called carrier pairs are produced in the surface layer of the photosensitive member. The carrier pairs have such a characteristic that they move in the layer or layers of the photosensitive material in accordance with the direction of an electric field to neutralize a charge in the surface layer of the photosensitive member 1. The image forming apparatus further includes a charger 2 for charging the surface of the photosensitive member 1, an optical writing device 3 for irradiating light upon the photosensitive member 1 in accordance with image information, a developing device 4 for causing toner powder to be adhered to the photosensitive member 1, a transfer device 5 for transferring toner powder from the photosensitive member 1 to a lower face of a record sheet 11 of paper, and a charger 12 for charging toner powder remaining on the photosensitive drum 1 after transfer. The charger 12 will be hereinafter referred to as a pre-charger. A charge removing device 7 for removing a charge from the photosensitive member 1 is disposed behind the pre-charger 12. The image forming apparatus further includes a cleaning device 8 which in turn includes a cleaning brush 13 formed from filaments 13*a* wherein carbon is contained by a predetermined amount in high-molecular fiber of nylon, acrylic resin, rayon, polycarbonate resin, polyester or polyvinyl, a collector roll 14 for collecting toner powder from the cleaning brush 13, and a scraper 16 for mechanically scraping toner powder off the collector roll 14. The image forming apparatus further includes a fixing device 6 consisting of a pair of rollers for permanently fixing toner powder on record paper.

With the image forming apparatus having such a construction as described above, a reverse developing process including a cleaning process where a toner of the negative charge property and an organic photoconductor of the negative charge property are employed as toner and the photosensitive layer or layers of the photosensitive member 1, respectively, proceeds as follows.

The surface layer of the organic photoconductor of the photosensitive member 1 is charged to the negative polarity by the charger 2. Light is irradiated upon the surface of the orgainic photoconductor by the optical writing device 3, whereupon charge at each location upon which light is irradiated is removed while charge at the other locations upon which light is not irradiated remains so that a pattern of charge called an electrostatic latent image is formed on the surface layer of the organic photoconductor.

The electrostatic latent image is then converted into a visible image as toner powder which has been agitated within the developing device 4 and frictionally charged to the negative polarity is applied to the surface of the photoconductive member 1. Since a bias voltage of the same polarity as the polarity of charge of the organic photoconductor is applied to a developing roll within the developing device 4, toner powder will attach only to portions of the surface of the organic photoconductor from which charge has been removed, thereby effecting development (reverse development) of the electrostatic latent image.

Toner powder attached to the organic photoconductor by development is electrostatically transferred by corona discharge of the transfer device 5 to a lower face of record paper 11 which has been charged to the positive polarity, and the toner powder on the record paper 11 is then fixed by the fixing device 6, thereby recording information of an image for one page.

Toner powder T which has not been transferred remains on the organic photoconductor after the transfer and the remaining toner powder T is compulsorily charged to the negative polarity by corona discharge or the like, from the pre-charger 12, as illustrated in FIG. 8*c*. The organic photoconductor is charged to the negative polarity at the same time, but simultaneously with such charging, light is irradiated upon the organic photoconductor by the discharger 7 disposed behind the pre-charger 12 so that the charge in the surface layer of the organic photoconductor is removed rapidly. Since toner powder T itself does not have a photosensitive property, the charge thereof is not removed and remains therein even if light is irradiated thereupon.

The toner powder T which has been compulsorily charged to the negative polarity on the organic photoconductor by the pre-charger 12 is fed to a location near the conductive brush 13 as the photosensitive member 1 rotates. Since the conductive brush filaments 13*a* are rotated in the direction indicated by an arrow mark B in FIG. 1 and are slidably contacted with the surface of the organic photoconductor, toner powder T which is contacted with the conductive brush 13 is electrostatically attracted to the surface of the conductive brush 13*a* and removed from the organic photoconductor due to the fact that a positive bias voltage is applied to the conductive brush 13. Since the toner powder which is attached to the surface of the conductive brush filaments 13*a* carries a negative charge thereon, it is electrostatically attracted to and collected by the collector roll 14 to which a bias voltage of the positive polarity higher than the bias voltage to the conductive brush 13 is applied. The toner powder is then carried in the direction indicated by the arrow mark C in FIG. 1 and then mechanically scraped off the collector roll 14 by the scraper 16.

However, if the resistance of the cleaning brush is lower than $10^1$ megohms, when a bias voltage is applied to the brush 13, charge may leak from the brush 13 to neutralize the charge of toner powder. Consequently, no electrostatic attractive force will act between the brush filament 13*a* and the toner powder and removal of the toner powder from the brush filaments 13*a* will be disabled. If the resistance of the brush 13 is higher than $10^4$ megohms, the brush 13 itself will substantially exhibit an insulating property and no charge will be produced in the brush 13, even if a bias voltage is applied. Consequently, the toner powder cannot be removed from the brush filaments.

Accordingly, the resistance of the cleaning brush 13 must remain within a range from $10^1$ to $10^4$ megohms in order to achieve optimum cleaning.

EXAMPLE 1

Formation of an image and cleaning of the photosensitive member were conducted in accordance with process conditions shown in Table 1 below, and evaluation of the cleaning system for an image forming apparatus according to the present invention was conducted. It is to be noted that evaluation of the cleaning performance was conducted in accordance with a criterion shown in Table 2 below. Changes in environmental conditions and pre-charging current were employed while bias voltage of +300 volts and +700 volts were applied, respectively, to the cleaning brush and the collector roll which are both made of nylon in which carbon is contained and have an electric resistance of $10^3$ megohms. The results are shown in Table 3 below. As can be clearly seen from Table 3, it was proved that where a conductive brush to which a bias voltage is applied after the remaining toner powder has been pre-charged, effective cleaning can be attained always in any enviroment.

EXAMPLE 2

Cleaning tests were conducted in modified conditions wherein the bias voltages to be applied to the cleaning brush and the collector roll in the conditions of Example 1 above were modified to +500 volts and +1,100 volts, respectively. Such results as shown in Table 4 below were obtained. It was proved that effective cleaning can be attained at these voltages and with conditions similar to Example 1 above.

EXAMPLE 3

Bias voltages applied to the cleaning brush and the collector roll were set to +300 volts and +700 volts, respectively, and cleaning tests were conducted changing the resistance of the cleaning brush in environmental conditions of 10° C./20% RH (relative humidity) to 35° C./80% RH. Evaluation of the cleaning property depended on the criterion shown in Table 2. The resistance of the cleaning brush was changed by changing the amount of carbon contained in the nylon filaments. The results are shown in Table 5 below. It was thus proved that where the resistance of the cleaning brush used is within a range from $10^1$ to $10^4$ megohms, effective cleaning can be attained in any environment.

EXAMPLE 4

Cleaning tests were conducted in modified conditions wherein the bias voltages to be applied to the cleaning brush and the collector roll in the conditions of Example 3 above were modified to +500 volts and +1,100 volts, respectively. Such results as shown in Table 6 below were obtained. It was proved that, where a bias voltage is applied to the cleaning brush having a resistance within the range from $10^1$ to $10^4$ megohms, effective cleaning can be attained always in any condition similar to Example 3 above.

In this manner, with the cleaning system for an image forming apparatus according to the present invention, even if the charge of toner powder varies in polarity or magnitude in accordance with a change of environment, the cleaning performance of the cleaning system will not be deteriorated by a change in environment because the photosensitive member is cleaned after the toner powder remaining on the photosensitive member has been charged to a fixed polarity. Accordingly, the cleaning system can always clean the photosensitive member stably under the same conditions and in any environment.

Using the cleaning system for an image forming apparatus according to the present invention, colored fine particles are charged to a predetermined fixed polarity and are electrostatically removed from an image carrier by a conductive cleaning brush to which a bias voltage of the polarity opposite to the polarity of charge of colored fine particles has been applied. Accordingly, a stabilized cleaning performance can be maintained in any environment without changing the set values of the cleaning conditions.

Moreover, compared to a cleaning system which makes use of a mechanical scraping off force or an electrostatic force by frictional electrification, the rotational speed of a brush roll and the density and thickness of brush filaments of the conductive cleaning brush can be reduced because the cleaning system of the present invention makes use of a positive voltage applying means and a bias voltage. As a result, damage to the image carrier or conductive cleaning brush can be reduced, and accordingly, the life of them can be improved, while designing a rotating mechanism for them is facilitated.

Having now fully described the invention, it will be apparent to one of ordinary skill in the art that many changes and modifications can be made thereto without departing from the spirit and scope of the invention as set forth herein.

TABLE 1

| Process Conditions | Reverse Development of Two-Component System |
|---|---|
| Speed | 132 mm/sec |
| Image Carrier | Organic Photosensitive Member of Negative Charge |
| Developer | Magnetic Toner of Negative Charge |
| Brush | Conductive Brush of Nylon Family |
| Collector Roll | Aluminum Roll |

TABLE 2

| | |
|---|---|
| ◎ | Remaining toner powder is perfectly removed from the photosensitive member |
| ○ | A very small amount of toner powder remains unremoved on the photosensitive member but does not matter for practical use at all |
| Δ | Some toner powder remains unremoved on the photosensitive member but little matters for practical use |
| x | A considerable amount of toner powder remains unremoved and produces some stains on a solid picture image |
| xx | Unremoved toner powder produces significant stains on solid and line picture images |
| xxx | Formation of any picture image pattern is disabled |

TABLE 3

| Pre-Charge (microamperes) | Environmental Conditions (Temperature) Relative Humidity 10° C. 20% RH | 25° C. 60% RH | 35° C. 80% RH |
|---|---|---|---|
| −200 | ◎ | ◎ | ◎ |
| −100 | ◎ | ◎ | ◎ |
| 0 (no application) | ○ | ○ | x |

Brush +300 volts
Collector Roll +700 volts

TABLE 4

| Pre-Charge (microamperes) | Environmental Conditions (Temperature) Relative Humidity 10° C. 20% RH | 25° C. 60% RH | 35° C. 80% RH |
|---|---|---|---|
| −200 | ◎ | ◎ | ◎ |
| −100 | ◎ | ◎ | ◎ |
| 0 (no application) | ○ | ○ | x |

Brush +500 volts
Collector Roll +1100 volts

TABLE 5

| Pre-Charge (microamperes) | Resistance (Megohms) $10^0$ | $10^1$ | $10^2$ | $10^3$ | $10^4$ | $10^5$ |
|---|---|---|---|---|---|---|
| −200 | xx | | ◎ | ◎ | ○ | x |
| −100 | xxx | Δ | ◎ | ◎ | ○ | x |

Brush +300 volts
Collector Roll +700 volts

TABLE 6

| Pre-Charge (microamperes) | Resistance (Megohms) $10^0$ | $10^1$ | $10^2$ | $10^3$ | $10^4$ | $10^5$ |
|---|---|---|---|---|---|---|
| −200 | xxx | Δ | ◎ | ◎ | ◎ | Δ |
| −100 | xxx | Δ | ◎ | ◎ | ◎ | Δ |

Brush +500 volts
Collector Roll +1,100 volts

What is claimed is:

1. A cleaning system for an image forming apparatus of the type wherein an electrostatic latent image on an image carrier is developed with colored fine particles, and the colored fine particles of the developed image are transferred to a transfer medium, said cleaning system being provided to remove colored fine particles remaining on said image carrier after transfer of the developed image to said transfer medium, said cleaning system comprising a conductive cleaning brush for slidably contacting with said image carrier to remove colored fine particles remaining on said image carrier, a first voltage applying means coupled to said cleaning brush for applying a first bias voltage to said conductive cleaning brush of the polarity opposite to the polarity of the charge of the colored fine particles, a precharging means for charging said colored fine particles remaining on said image carrier to a polarity opposite to the polarity of said cleaning brush, whereby colored fine particles remaining on said image carrier are removed by said conductive cleaning brush, and light irradiating means for removing residual charges from the image carrier after the transfer, said light irradiating means and said precharging means being arranged such that they affect charging and light irradiation on the same portion of the image carrier, whereby said precharging means uniformalize the polarity of said colored fine particles remaining on the image carrier and, simultaneously, said light irradiating means removes residual charges on said image carrier, followed by cleaning by said cleaning brush.

2. A cleaning system according to claim 1, wherein said precharging means is a DC corona discharge means and has the same polarity as the polarity of charging of said colored fine particles.

3. An image forming apparatus, comprising a housing, a paper supply means for supplying paper therefrom, a discharged paper tray for receiving printed paper thereon, a paper transport path provided at an upper location within said housing and extending from said paper supply means to said discharged paper tray, an image carrier disposed below said paper transport path and having a surface on which an electrostatic latent image can be formed, a developing means for developing an electrostatic latent image formed on said image carrier with colored fine particles, a transfer device disposed in an opposing relationship to said image carrier across said paper transport path for transferring a visible image developed by said developing means to a lower face of paper supplied from said paper supply means, a precharging means for charging colored fine particles remaining on said image carrier after transfer of the developed visible image to a predetermined fixed polarity, a conductive cleaning brush for removing said remaining colored fine particles, a first power source coupled to said conductive cleaning brush for applying a first bias voltage to said conductive cleaning brush of opposite polarity to said colored fine particles, and light irradiating means for removing residual charge from the image carrier after the transfer, said light irradiating means and said precharging means being arranged such that they affect charging and light irradiation on the same portion of the image carrier, whereby said precharging means uniformalize the polarity of said colored fine particles remaining on the image carrier, and, simultaneously, said light irradiating means removes residual charges on said image carrier, followed by cleaning by said cleaning brush.

4. An image forming apparatus according to claim 3, wherein said precharging means is a DC corona discharge means and has the same polarity as the polarity of charging of said colored fine particles.

5. A cleaning system for an image forming apparatus of the type wherein an electrostatic latent image is formed on an image carrier and developed with colored fine particles, and the colored fine particles of the developed image are transferred to a transfer medium to form an image on the transfer medium, said cleaning system comprising a precharging means for charging colored fine particles remaining on said image carrier after transfer of the developed image to the transfer medium to a first polarity, a conductive cleaning brush located adjacent to said image carrier for removing the colored fine particles remaining on said image carrier, a means for applying a first bias voltage to said conductive cleaning brush of a polarity opposite to the polarity of charge on the colored fine particles, and light irradiating means for removing residual charge from the image carrier after the transfer, said light irradiating means and said precharging means being arranged such that they affect charging and light irradiation on the same portion of the image carrier, whereby said precharging means uniformalize the polarity of said colored fine particles remaining on the image carrier, and, simultaneously, said light irradiating means removes residual charges on said image carrier, followed by cleaning by said cleaning brush.

6. A cleaning system according to claim 5, wherein said precharging means is a DC corona discharge means and has the same polarity as the polarity of charging of said colored fine particles.

* * * * *